United States Patent [19]

Vaughan

[11] 4,118,046

[45] Oct. 3, 1978

[54] ROCKER ASSEMBLY FOR WHEELCHAIRS

[76] Inventor: Curtis T. Vaughan, 1925 Jackson, Joplin, Mo. 64801

[21] Appl. No.: 815,678

[22] Filed: Jul. 14, 1977

[51] Int. Cl.[2] ..... A47C 3/029

[52] U.S. Cl. ..... 280/289 WC; 280/30; 297/270

[58] Field of Search ..... 280/30, 43.15, 242 WC, 280/289 WC; 297/270

[56] References Cited

U.S. PATENT DOCUMENTS

| | | | |
|---|---|---|---|
| 404,767 | 6/1889 | Botkin | 280/30 |
| 745,334 | 12/1903 | Dutton | 280/43.15 |
| 1,481,650 | 1/1924 | Murphy | 280/30 X |

*Primary Examiner*—Joseph F. Peters, Jr.
*Assistant Examiner*—Michael Mar
*Attorney, Agent, or Firm*—Schmidt, Johnson, Hovey & Williams

[57] ABSTRACT

A removable, easy to use rocker assembly is provided which can be quickly installed on a standard wheelchair without modifications or damage to the same and which includes a pair of shiftable arcuate rockers movable between a retracted and rocking position without the necessity of having the occupant leave the wheelchair, or complicated, time-consuming adjustments of the assembly or chair itself. The overall rocker assembly includes a pair of separate, identical, rocker structures respectively and removably mounted adjacent the wheels of the chair and independently shiftable for selective positioning of the rockers in a chair-supporting, rocking position. The rocker structures each include a frame removably secured to the wheelchair, linkage pivotally coupled between the frame and rocker, and stabilizing means for preventing unintended movement of the rocker in use thereof relative to the chair so as to present an extremely stable rocking wheelchair. Operating mechanism having a shiftable handle is also provided for easy selective movement of the rockers by a person sitting in the chair or by an attendant.

10 Claims, 4 Drawing Figures

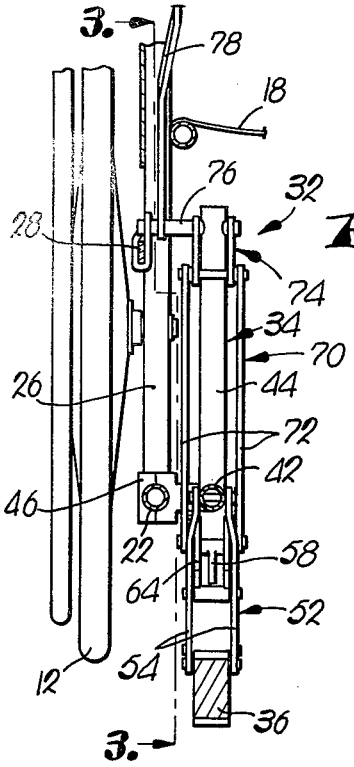
Fig.2.
Fig.1.
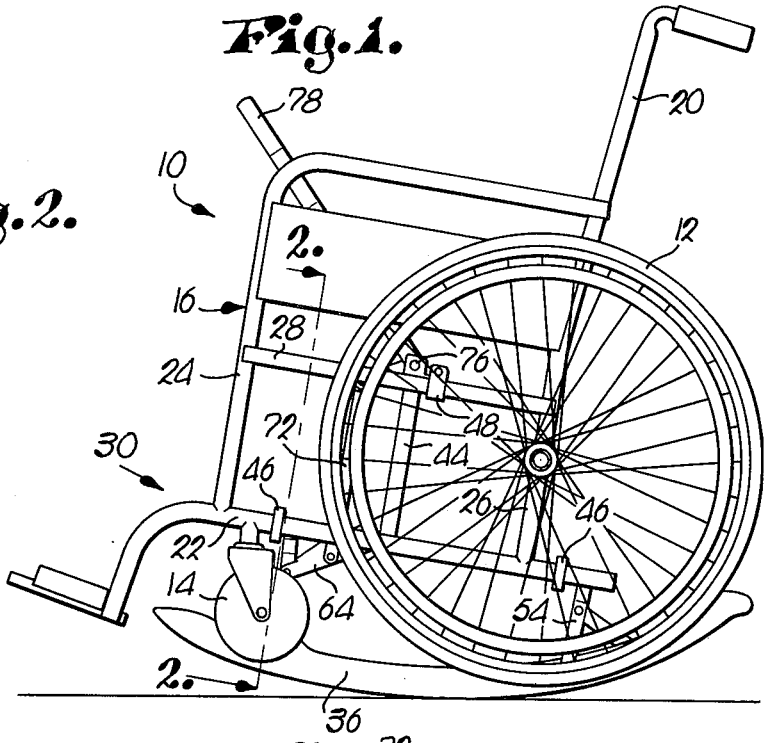
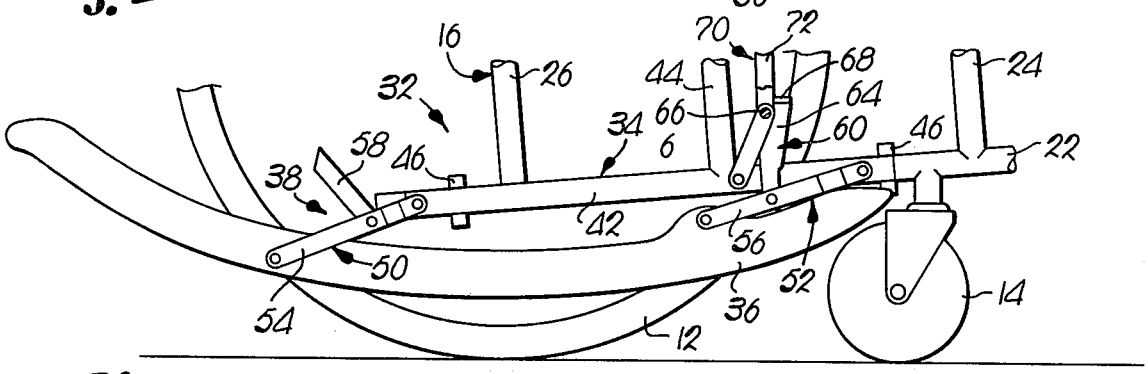
Fig.4.
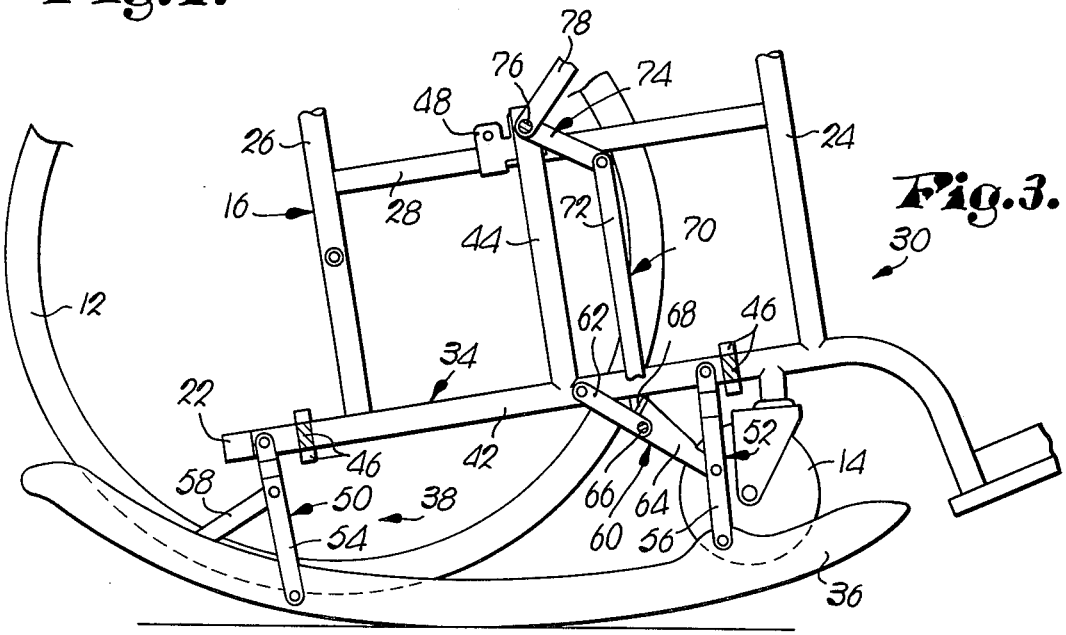
Fig.3.

ROCKER ASSEMBLY FOR WHEELCHAIRS

This invention relates to a selectively usable rocking assembly which can be mounted on standard wheelchairs in order to allow users thereof to rock as desired. More particularly, it is concerned with such a rocker assembly which preferably includes a pair of separate, independently operable rocking structures removably mounted on a wheelchair, and which are easy to use and do not require extensive modifications of the wheelchair or difficult, time-consuming procedures when it is desired to shift the rockers during use thereof.

Invalids and others confined to wheelchairs have often expressed a desire to be able to rock in the conventional fashion, in order to lessen the monotony of sitting in, and use of, a wheelchair. In addition, medical authorities have indicated that rocking for such people can be beneficial in terms of increased blood circulation and other advantageous physical effects. It will readily be appreciated though, that it can be a difficult and sometimes arduous task for an invalid to transfer or be transferred from a wheelchair to a conventional rocking chair. This has in turn tended to lessen the opportunity for rocking on the part of invalids and the like.

It has been suggested in the past to provide convertible chairs which include wheels and rockers, along with structure for allowing conversion of the chair between the two modes of use. However, a prime deficiency of such prior constructions resides in the fact that they are especially constructed and designed to be convertible, and are therefore expensive and not readily available. Furthermore, prior convertible chairs have without known exception been extremely complicated and somewhat difficult to use. In some instances it is necessary to transfer the occupant prior to conversion of the chair, and this of course in large measure defeats the purpose of having such a convertible chair.

Prior patents of background interest which describe various types of convertible chairs of the type alluded to above include: U.S. Pat. Nos. 331,111, 318,673, 404,767, 1,026,276, 2,541,955 and 3,306,660. None of the units described in these patents relate to a rocker assembly which can be removably mounted onto a standard existing wheelchair; moreover, these patents for the most part describe chairs which are extremely complicated and difficult to use.

It is therefore the most important object of the present invention to provide a rocker assembly which can be easily and quickly mounted onto a standard wheelchair without the necessity of modifying or damaging the same, and which can be selectively used for rocking purposes by a simple adjustment procedure without the necessity of having the wheelchair user leave the chair.

As a corollary to the foregoing, another object of the invention is to provide a rocker assembly of the type described which includes a pair of separate, identical rocker structures removably mounted on a conventional wheelchair adjacent the wheels thereof; each rocker structure preferably includes a frame assembly removably mounted to the wheelchair, an arcuate, unitary rocker, linkage means shiftably coupling the rocker to the frame assembly, and means for stabilizing the rocker in the use position thereof in order to present an extremely safe, stable rocker for an invalid.

A still further object of the invention is to provide a rocker assembly which includes a pair of shiftable rockers operatively coupled to a standard wheelchair, along with operating mechanism for selective shifting of the rockers by a person sitting in the chair, or an attendant, without the necessity of having the wheelchair user leave the chair during conversion thereof to a rocking wheelchair.

In the drawing:

FIG. 1 is a side elevational view of a conventional wheelchair having the rocker assembly of the present invention mounted thereon, and with the assembly shifted to its chair-supporting, rocking position;

FIG. 2 is a vertical sectional view taken along line 2—2 of FIG. 1 which illustrates in detail one of the rocker structures of the overall rocker assembly;

FIG. 3 is a vertical sectional view taken along irregular line 3—3 of FIG. 2 which further illustrates the construction of the rocker structures; and FIG. 4 is a fragmentary side elevational view with parts broken away for clarity of a rocker structure of the present invention, shown with the rocker thereof in its retracted, storage position.

Turning now to the drawing, a conventional wheelchair 10 is illustrated in FIG. 1. Wheelchair 10 includes the usual spaced apart sets of wheels 12 and 14, along with respective side frames 16, horizontal seat 18 and upright backrest 20. As illustrated, each side frame 16 includes a lower, generally horizontally extending bar 22, along with spaced upright bars 24 and 26 and a secondary, horizontal flat bar 28 above bar 22.

A rocker assembly broadly referred to by the numeral 30 is removably mounted on standard wheelchair 10. Briefly, assembly 30 includes separate, identical rocker structures 32 which are respectively mounted adjacent the side frames 16 of wheelchair 10. Each structure 32 includes a frame assembly 34, and means for removably mounting the assemblies 34 to the respective side frames 16. In addition, each structure 32 has an arcuate, unitary rocker 36, along with means generally referred to by the numeral 38 for shiftably coupling the rocker 36 to the associated frame assembly 34. Finally, operating mechanism 40 is provided for selectively shifting the associated rocker 36 between the retracted storage and chair-supporting rocking positions thereof, as will be described.

In more detail, each frame assembly 34 includes a lowermost, generally horizontally extending tubular bar member 42, along with an upright, generally centrally disposed bar 44. As illustrated, tubular member 42 is disposed in adjacent, side-by-side alignment with bar 22 of the adjacent side frame 16, while upright bar 44 is located between the bars 24 and 26.

A pair of identical, conventional coupling members 46 are provided for releasably interconnecting member 42 to the adjacent bar 22 (see FIG. 2). In addition, an upper clamp 48 is provided for releasably securing bar 44 to the secondary horizontal bar 28 of the associated side frame 16. It is to be noted in this connection that securement of the respective frame assemblies 34 to the corresponding side frames 16 of wheelchair 10 is effected without any permanent modification or alteration of the wheelchair itself.

Coupling means 38 for each rocker structure 32 includes a pair of spaced, generally parallel linkage arms 50 and 52. Arm 50 includes a pair of interconnected, spaced, side-by-side flat metallic elements 54 which are pivoted at the respective ends thereof to tubular member 42 and rocker 36. Similarly, arm 52 includes a pair of side-by-side, interconnected, elements 56 which are pivoted at the ends thereof to tubular member 42 and rocker 36.

Coupling means 38 also includes stabilizing structure for preventing unintended movement between the rocker 36 and chair 10 when the rocker structure is in use. This stabilizing structure includes a first bracing leg 58 which is fixedly secured to and extends obliquely from the first linkage arm 50. Moreover, a second stabilizing leg 60 extends obliquely upwardly between the arm 52 and tubular member 42. Leg 60 includes a pair of elongated sections 62 and 64 which are pivotally connected together at the adjacent inner ends thereof by means of a pin 66. Section 62 includes a pair of spaced, side-by-side metallic elements which are pivotally connected at the outer ends thereof to the tubular member 42; section 64 on the other hand comprises a pair of side-by-side metallic elements having the outer ends thereof pivotally secured to the arm 52. The sections 60 also include a pair of elongated upwardly extending, side-by-side, outwardly flared stop members 68 which extend beyond pin 66 and are important for purposes to be made clear.

Operating mechanism 40 includes an elongated, vertically oriented link 70 made up of a pair of side-by-side, flat metallic elements 72. The link 70 is pivoted to second leg 60 at the point of interconnection between the respective sections 62 and 64, i.e., to pin 66. A second link 74 is pivotally coupled at the respective ends thereof to the upper end of link 70, and to a pivoting cross pin 76. The latter (see FIG. 2) is generally horizontally disposed and extends through the link 74, upright bar 44 and clamp 48. An operating handle 78 is fixedly secured to the pin 76 for rotation of the latter in response to shifting of the operating handle.

In use, the respective rocker structures 32 are removably secured to wheelchair 10 by attaching the individual frame assemblies 34 to the side frames 16 of the wheelchair. This involves merely placing the associated rocker structures adjacent to the side frames, and tightening the releasable coupling members 46 and clamp 48 so as to secure the structures 32 in place. In this orientation the respective operating handles 78 will extend upwardly between the side frames 16 and the seat 18 in disposition for easy use.

The rockers 36 forming a part of rocker assembly 30 are selectively shiftable between a retracted storage position illustrated in FIG. 4, and a ground-engaging, chair-supporting rocking position illustrated in FIGS. 1–3. Assuming that the rockers are in their retracted storage position, the following procedure is followed. A handle 78 is first pushed forwardly so as to cause downward vertical shifting movement of the associated link 70. This in turn causes downward translation of the pivot defined by the pin 66 between the respective sections 62 and 64 of second leg 60. As this action proceeds, the rocker is shifted forwardly and downwardly from its FIG. 4 position until it engages the floor or other support surface and begins to lift wheelchair 10. This proceeds until the secondary leg 60 assumes the extended, rigidified position best illustrated in FIG. 4, with the respective sections 62 and 64 being fully extended. Further pivoting of the sections 62 and 64 is prevented by virtue of the abutment between the stops 68 carried by the section 64 against the aligned section 62, as best seen in FIG. 3.

During the above described sequence, the arms 50 and 52 are pivoted until they assume their somewhat upright use position best illustrated in FIG. 3. Additionally, bracing leg 58 is rotated with the arm 50 until, at the point where the stops 68 engage the section 62 to rigidify the leg 60, the underside of the bracing leg 58 comes into engagement with the upper surface of the rocker 36. This provides additional support for the overall rocker units in order to assure that the rockers are not moved relative to the wheelchair during rocking.

The remaining rocker structure 32 is then shifted in a manner identical to that described above so as to lift the entire wheelchair 10 off of the floor surface. In this orientation the chair is supported solely by the rockers 36, and the rigidifying means described assures that an extremely safe, stable condition is maintained during rocking.

When it is desired to resume use of chair 10 in the conventional manner, it is only necessary to pull backwardly on the respective handles 78. This is preferably done in sequential order so that the chair is gently lowered. In any event, such shifting of the handles 78 reverses the above described procedure and has the effect of lowering the chair 10 until the wheels thereof engage the supporting surface. The handles are moved in this manner until the rockers 36 are shifted back into their retracted storage position, illustrated in FIG. 4.

A prime advantage of the rocker assembly of the present invention stems from the fact that it can be removably mounted on an existing wheelchair without modifications thereof. Furthermore, the assembly is usable by a person sitting in the wheelchair, or by an attendant, without the necessity of leaving the chair itself. This adds a large measure of flexibility to the use of rocker assembly 30 which has been lacking in prior units of this type.

Having thus described the invention, what is claimed as new and desired to be secured by Letters Patent is:

1. Rocker structure for mounting on a wheelchair and comprising:

a frame assembly;

means for removably mounting said frame assembly to said wheelchair;

a rocker unit including an arcuate rocker adapted to engage a support surface, and means shiftably coupling said rocker to said frame assembly for movement of the rocker, when the frame assembly is mounted on the wheelchair, between a retracted storage position and a use position wherein the rocker is in engagement with said support surface for rockably supporting the wheelchair, said coupling means including a pair of spaced, generally parallel linkage arms, means pivotally connecting each of the arms between said rocker and frame assembly, and stabilizing means comprising a first rigid bracing leg secured to one of said arms for engaging the rocker when the latter is in said use position, a second leg for the other of said arms which includes a pair of pivotally interconnected sections, means pivotally securing one end of the second leg to the other of said arms, means pivotally securing the remaining end of said second leg to said frame assembly, and means for rigidifying said second leg when the rocker is in said use position; and an operating mechanism operatively connected to said rocker unit for selectively moving said rocker between said retracted and use positions.

2. Rocker structure as set forth in claim 1 wherein said operating mechanism includes an operating handle adjacent the seat of said wheelchair, and linkage structure coupled between said handle and said rocker unit for movement of said rocker between said retracted and use positions when said handle is shifted by a person sitting in said seat.

3. Rocker structure as set forth in claim 1 wherein said rigidifying means includes a stop member carried by one of the sections of the second leg and engageable with the other section thereof.

4. Rocker structure as set forth in claim 1 wherein said operating mechanism includes a shiftable link coupled to said second leg at the pivotal connection of the sections thereof, and handle means connected to said link for selective movement thereof.

5. A rocker assembly for mounting on a wheelchair and comprising:

a pair of spaced apart, arcuate rockers adapted to engage a support surface; and means shiftably coupling said rockers to a wheelchair for selective movement thereof between a retracted storage position and a use position wherein said rockers are in engagement with said support surface for rockably supporting said wheelchair, said coupling means including a pair of generally parallel linkage arms for each rocker respectively;

means pivotally connecting said pairs of arms in spaced relationship on each of said rockers respectively;

means pivotally supporting the ends of said pairs of arms remote from said rockers for selective movement of the rockers between said retracted and use positions;

means for stabilizing said rockers against unintended movement thereof when the rockers are in said use position, said stabilizing means comprising a first, rigid bracing leg secured to one of said arms of each pair thereof for engaging the corresponding adjacent rocker, a second leg for the other of said arms of each pair thereof which includes a pair of pivotally interconnected sections, means pivotally securing one end of each of said second legs to one of said other arms, means pivotally supporting the remaining end of each of said second legs, and means for rigidifying each of said second legs when said rockers are in said use position.

6. The rocker assembly as set forth in claim 5 wherein said rigidifying means includes a stop member carried by one of said sections of each of said second legs and engageable with the other section of same second leg.

7. The rocker assembly as set forth in claim 5 wherein said rockers are of unitary construction.

8. The rocker assembly as set forth in claim 5 wherein said means for pivotally supporting the ends of said pairs of arms remote from said rockers includes respective frames for each pair of arms, and means removably connecting said frames to said wheelchair.

9. The rocker assembly as set forth in claim 5 including operating means operatively connected to each of said second legs for selective shifting of said rockers between said retracted and use positions.

10. The rocker assembly as set forth in claim 5 including separate, independent operating means respectively connected to said second legs for independent, selective shifting of said rockers between said retracted and use positions.

* * * * *